US005868119A

United States Patent [19]

Endo et al.

[11] Patent Number: 5,868,119

[45] Date of Patent: Feb. 9, 1999

[54] FUEL TANK VENTING SYSTEM FOR VEHICLES

[75] Inventors: Yasunobu Endo; Atsushi Ota; Tsuyoshi Chiyou; Hisayuki Goma; Masaaki Horiuchi, all of Wako, Japan

[73] Assignee: Honda Giken Kogyo Kabushiki Kaisha, Tokyo, Japan

[21] Appl. No.: 72,928

[22] Filed: May 5, 1998

[30] Foreign Application Priority Data

May 14, 1997 [JP] Japan ..... 9-137999

[51] Int. Cl.[6] ..... F02M 33/02

[52] U.S. Cl. ..... 123/516; 123/520

[58] Field of Search ..... 123/516, 518, 123/519, 520, 521

[56] References Cited

U.S. PATENT DOCUMENTS

| | | | |
|---|---|---|---|
| 5,209,210 | 5/1993 | Ikeda | 123/516 |
| 5,277,168 | 1/1994 | Kondo | 123/519 |
| 5,474,048 | 12/1995 | Yamazaki | 123/519 |
| 5,596,971 | 1/1997 | Kidokoro | 123/516 |
| 5,606,954 | 3/1997 | Yamazaki | 123/520 |
| 5,647,334 | 7/1997 | Miller | 123/520 |
| 5,669,361 | 9/1997 | Weissinger | 123/520 |
| 5,671,718 | 9/1997 | Curran | 123/520 |

FOREIGN PATENT DOCUMENTS 51-3290 1/1976 Japan .

*Primary Examiner*—Carl S. Miller
*Attorney, Agent, or Firm*—Frishauf, Holtz, Goodman, Langer & Chick

[57] ABSTRACT

A fuel tank venting system for a vehicle comprises first and second vent passages connected to the fuel tank, and a third vent passage connected to the fuel tank. The first to third vent passages each have one end thereof located in the fuel tank at an upper front location thereof, an upper rear location thereof, and an upper central location thereof, respectively. An anti-overcharging valve is arranged in the fuel tank and connected to the other end of the third vent passage. A first valve is connected to the one ends of the first and second vent passages, and a confluent vent passage extends from the first valve toward an internal combustion engine installed in the vehicle. A second valve is arranged across the confluent vent passage on one side of the first valve closer to the engine. The third vent passage has the other end thereof connected to the confluent vent passage at a location intermediate between the first valve and the second valve. The sum of set pressure of the first valve and set pressure of the second valve is set to a value higher than head pressure of the fuel tank assumed when the fuel tank is fully charged.

8 Claims, 2 Drawing Sheets

FUEL TANK VENTING SYSTEM FOR VEHICLES

BACKGROUND OF THE INVENTION

1. Field of the Invention

This invention relates to a fuel tank venting system for vehicles such as motor cars, which operates to secure ventilation between the interior and exterior of the fuel tank even when the fuel tank is tilted.

2. Prior Art

Conventionally, a fuel tank venting system of this kind is known, for example, from Japanese Utility Model Publication (Kokoku) No. 51-3290, which includes a front vent pipe having a front inclined portion and a rear inclined portion, the front inclined portion having an open end thereof arranged above the fuel liquid surface within the fuel tank, a vertically extending increased-volume vent pipe connected to the rear inclined portion, a rear vent pipe extending rearward of the fuel tank with an open end thereof located above the fuel liquid surface within the fuel tank at a rear side of the fuel tank and the other end thereof connected to an upper end of the increased-volume vent pipe, and a drain pipe connected at an end thereof to an upper portion of the increased-volume vent pipe and communicating at the other end thereof with the atmosphere or the like via a check valve (hereinafter referred to as "the first conventional system").

According to the first conventional system, when the fuel tank is tilted forwardly of the vehicle such that a front side of the fuel tank lowers, the open end of the rear vent pipe becomes positioned above the fuel liquid surface. Therefore, when the temperature of the fuel tank rises to increase the pressure of air within the fuel tank, part of the air flows through the rear vent pipe and the drain pipe to open the check valve to be emitted into the atmosphere or the like. As a result, no fuel flows out of the fuel tank.

On the other hand, when the fuel tank is tilted rearwardly of the vehicle such that the rear side of the fuel tank lowers, the open end of the rear vent pipe becomes blocked with the fuel. Then, part of the air within the fuel tank is moved into the increased-volume vent pipe as its pressure rises and stays there. Then, upon reaching a lower end of the increased-volume vent pipe, the air floats upward in the form of bubbles in the increased-volume vent pipe without pushing upward fuel in the pipe which has been introduced into the pipe via the open end of the front vent pipe and then is emitted into the atmosphere or the like via the drain pipe.

Further, another fuel tank venting system of this kind is conventionally known, which includes an anti-overcharging valve for prevention of fuel overcharging formed by a float valve, and a cut valve formed by a float valve integrally connected to a check valve arranged in a charging passage extending between a fuel tank and a canister, and a spring urging the float valve in a direction of closing the same, the float valves being arranged at one end of the charging passage in the fuel tank at an upper central location thereof, and a two-way valve arranged in the charging passage at a location downstream of the anti-overcharging valve (hereinafter referred to as "the second conventional system"). The sum of the set pressure of the check valve and the set pressure of the two-way valve is set to a value larger than a head pressure of the fuel tank (pressure difference between the fuel liquid surface within the fuel tank and a fuel inlet end of a filler pipe of the fuel tank) assumed when the fuel tank is fully charged and hence the anti-overcharging valve is closed, to thereby restrain the head pressure when the fuel tank is fully charged, thus preventing overcharging of the fuel tank with fuel.

According to the first conventional system, however, as an element which can control the pressure within the fuel tank, only a single valve i.e., the check valve is arranged in the exhaust pipe, which therefore has a high set pressure (valve opening pressure) to prevent overcharging of the fuel tank, which renders it difficult to satisfy a puff-loss condition which is prescribed by United States fuel vapor emission standards (i.e., the pressure within the fuel tank should be controlled below a predetermined value lower than the valve opening pressure in a designated test mode).

On the other hand, according to the second conventional system, if the fuel tank is of a thin and oblong type, only the single cut valve arranged at the upper central location in the fuel tank cannot satisfactorily achieve gas-liquid separation performance. This is because the cut valve becomes immersed in the fuel when the fuel tank is tilted or inclined, and therefore when the pressure within the fuel tank rises due to heat or the like, air within the fuel tank cannot escape, which causes fuel to flow through the cut valve toward the engine. If two cut valves are provided in the fuel tank to overcome this inconvenience, these cut valves must be separately arranged on opposite sides of the fuel tank to satisfactorily achieve the gas-liquid separation performance, which inevitably leads to provision of two anti-overcharging valves on the opposite sides of the fuel tank. As a result, if refueling is made at a gas station having a sloping floor, for example, fuel is poured into the fuel tank to such a level as high as the level of one of the cut valves (which are integrally connected to the anti-overcharging valves) which is then positioned at a higher level. Thus, the fuel tank is overcharged with an amount of fuel much larger than an amount charged when the fuel tank is in a horizontal position. In such an overcharged state, if the pressure within the fuel tank rises, there is a fear that fuel can flow through the cut valve, which is then positioned at a lower level, toward the engine, which hinders satisfactory achievement of the gas-liquid separation performance.

SUMMARY OF THE INVENTION

It is the object of the invention to provide a fuel tank venting system for vehicles, which has a simple construction but is capable of not only positively satisfying the puff-loss condition but also preventing overcharging of the fuel tank irrespective of inclination of the fuel tank while achieving good gas-liquid separation performance, even when the fuel tank is of a thin and oblong type.

To attain the object, the present invention provides a fuel tank venting system for a vehicle having an internal combustion engine installed therein, comprising:

- first and second vent passages connected to the fuel tank and each having one end thereof located in the fuel tank at opposite sides and upper locations thereof, the first and second vent passages having other ends;
- a third vent passage connected to the fuel tank and having one end thereof located in the fuel tank at an upper central location thereof;
- an anti-overcharging valve arranged in the fuel tank and connected to the one end of the third vent passage;
- a first valve connected to the other ends of the first and second vent passages;
- a confluent vent passage extending from the first valve toward the engine; and
- a second valve arranged across the confluent vent passage on one side of the first valve closer to the engine;
- the third vent passage having another end thereof connected to the confluent vent passage at a location intermediate between the first valve and the second valve;

a sum of set pressure of the first valve and set pressure of the second valve being set to a value higher than head pressure of the fuel tank assumed when the fuel tank is fully charged.

With the above arrangement, since the anti-overcharging valve is connected to one end of the third vent passage located at the upper central location of the fuel tank, even when refueling is made at a gas station with a sloping floor, the fully charged amount of the fuel tank can be kept to the minimum variation. Further, since the two cut valves are separately located in the fuel tank at the opposite sides and upper locations thereof, when the fuel tank is inclined, one of the cut valves positioned at an upper level is open. As a result, when the pressure within the fuel tank rises, air can escape from the fuel tank, which can prevent fuel from flowing toward the engine. Thus, the gas-liquid separation performance can be achieved. When the anti-overcharging valve is closed, the sum of the set pressure of the first valve and the set pressure of the second valve is set to the value higher than the head pressure assumed when the fuel tank is fully charged, and therefore overcharging of the fuel tank can be prevented. Still further, since the third vent passage is connected to the confluent vent passage at the location intermediate between the first valve and the second valve, the maximum pressure within the fuel tank is controlled to the set pressure of the second valve, which makes it possible to satisfy the puff-loss condition prescribed by United States fuel vapor emission standards, i.e. a condition that in a designated test mode the pressure within the fuel tank after refueling should be controlled below a predetermined value lower than the valve opening pressure of the anti-overchanging valve which is set to such a value as prevent overcharging of the fuel tank at refueling.

Preferably, the fuel tank venting system includes a gas-liquid separator interposed between each of the other ends of the first and second vent passages and the first valve.

With the above arrangement, even if the fuel tank is tilted in one direction or the other direction, fuel flowing from the fuel tank through the first vent passage or the second vent passage is temporarily stored in either of the gas-liquid separators, and does not flow through the separator toward the engine side.

Also preferably, the fuel tank venting system includes a cut valve arranged in the fuel tank and connected to each of the one ends of the first and second vent passages.

As a result, fuel is prevented from flowing through either of the first vent passage or the second vent passage when the vehicle overturns.

Advantageously, the third vent passage has a rise portion vertically extending to such a height that head pressure thereof is higher than the set pressure of the first valve.

With the above arrangement, when the fuel tank is tilted in one direction, fuel within the fuel tank flows through the third vent passage and the fuel liquid surface rises by the set pressure of the first valve. However, since the third vent passage is provided with the rise portion having such the height that the head pressure thereof is higher than the set pressure of the first valve, fuel within the fuel tank is prevented from passing the top of the rise portion of the third vent passage to flow toward the engine.

Specifically, the first valve comprises a check valve.

Also specifically, the second valve comprises a two-way valve.

Preferably, the first valve has a restriction formed therein.

As a result, the restriction serves to restrain the amount of the rise of the fuel liquid surface within the rise portion, which makes it possible to lower the height of the rise portion of the third vent passage. As a result, the fuel tank venting system can be arranged in a narrow space of a chassis of the vehicle.

Advantageously, the gas-liquid separator is arranged at a side of the fuel tank opposite to a side of the fuel tank at which an associated one of the first valve and the second valve is arranged.

As a result, even if the vehicle is repeatedly inclined in a longitudinal or a lateral direction, fuel can be prevented from flowing toward the engine, leading to good achievement of the gas-liquid separation performance.

The above and other objects, features and advantages of the invention will be more apparent from the following detailed description taken in conjunction with the accompanying drawing.

DETAILED DESCRIPTION

The invention will now be described in detail with reference to the drawings showing an embodiment thereof.

Figure 1:
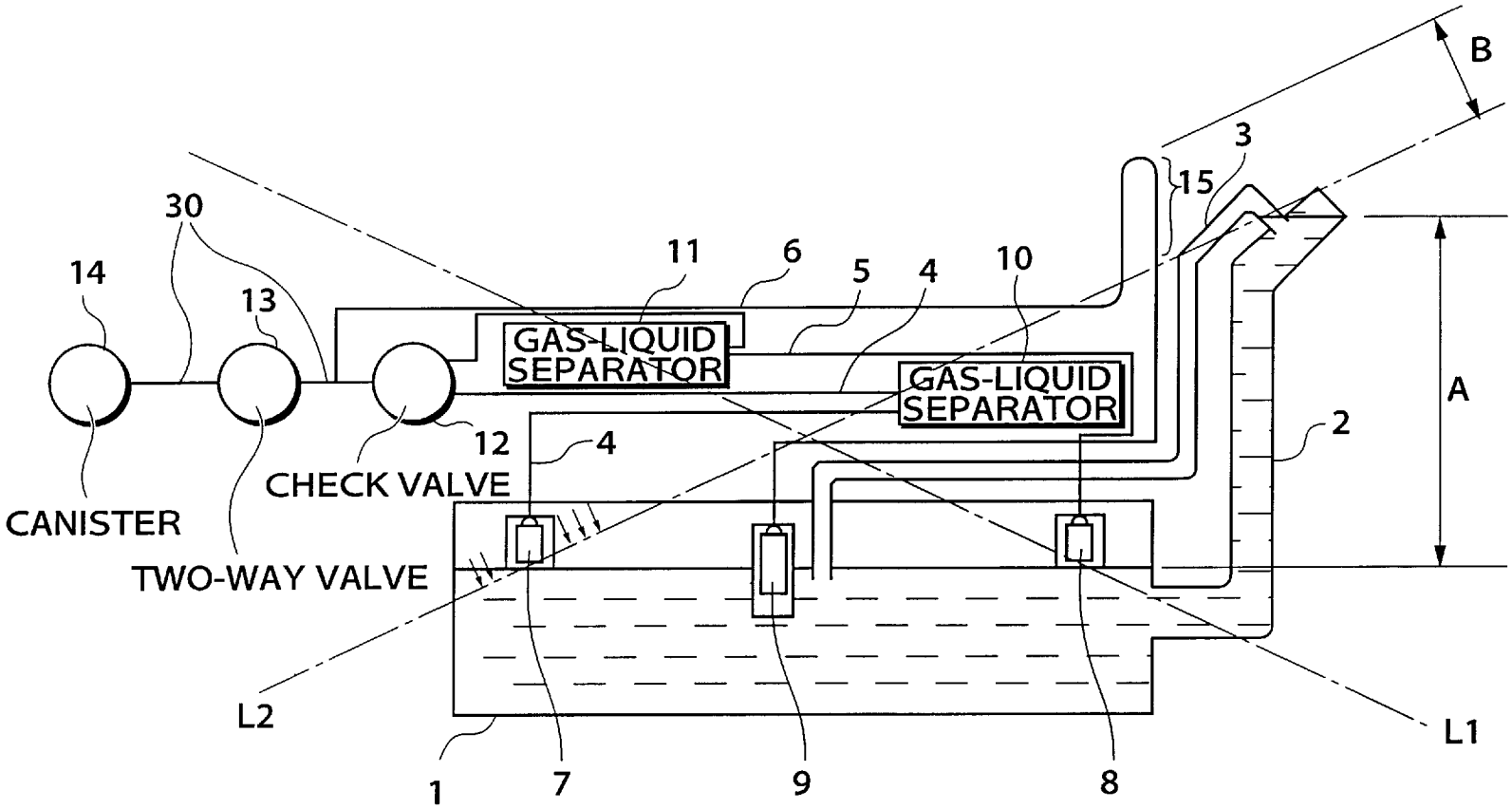
FIG. 1 is a longitudinal sectional view showing the construction of a fuel tank venting system for a vehicle, according to an embodiment of the invention.

Referring first to FIG. 1, there is schematically illustrated the construction of a fuel tank venting system which is installed in a vehicle such as a motor car, according to an embodiment of the invention. In the figure, reference numeral 1 designates a fuel tank of a thin and oblong type, which is fixed to a chassis of the vehicle, not shown, at a predetermined location thereof, by means of suitable fixing means. The fuel tank 1 has a rear end wall (the right side wall as viewed in the figure) to which is connected one end of a filler pipe 2. The other end of the filler pipe 2 opens in an external surface of the chassis and can be opened and closed by means of a cap, not shown.

A breather pipe 3 has one end thereof inserted into the fuel tank 1 at an upper central location thereof. The other end of the breather pipe 3 extends to and joined with a peripheral wall of the other end of the filler pipe 2. At refueling, as the fuel tank 1 is charged with fuel through the filler pipe 2, air within the fuel tank 1 is discharged through the breather pipe 3 into the filler pipe 2, and is emitted from the other open end of the filler pipe 2 into the atmosphere. When the fuel level within the fuel tank 1 rises to such a level that the end portion of the breather pipe 3 is immersed into the fuel, refueling of the fuel tank 1 is automatically stopped.

Connected to the interior of the fuel tank 1 are first, second and third vent pipes 4, 5 and 6 forming first, second and third vent passages, respectively, which each have one end thereof located at an upper front location (upper left portion as viewed in the figure), an upper rear location (upper right portion as viewed in the figure), and an upper central location of the fuel tank 1, respectively. Cut valves 7 and 8 each formed by a float valve are arranged in the fuel tank 1 and connected to the one ends of the first and second vent pipes 4 and 5, respectively. The float valves are each urged by a spring, not shown, in a direction of closing the valve. Further, an anti-overcharging valve 9 formed by a float valve is also arranged in the fuel tank 1 and connected to the one end of the third vent pipe 6. The anti-overcharging value 9 is located on a level slightly lower than the cut valves 7 and 8. The anti-overcharging valve 9 is of a normally open type which is closed when the fuel level within the fuel tank 1 exceeds a predetermined level (the fuel is in an almost fully charged state).

When the fuel tank is tilted, the cut valve 7 or 8 that is then positioned at a lower level is closed due to the action of the float valve, and when the vehicle overturns, the cut valves 7 and 8 are closed due to the action of the springs. The other ends of the first and second vent pipes 4 and 5 are connected via respective gas-liquid separators 10 and 11 to a check valve (first valve) 12. A confluent vent passage 30 extends from the check value 12 and is connected via a two-way valve (second valve) 13 to a canister 14 which is connected to an intake pipe of an internal combustion engine, not shown, installed in the vehicle. The other end of the third vent pipe 6 is connected to the confluent vent passage 30 at a location intermediate between the valves 12 and 13. The sum of the set pressure of the check valve 12 and the set pressure of the two-way valve 13 is set to a value higher than a head pressure (pressure difference between the fuel surface within the fuel tank 1 and the other end of the filler pipe 2) A assumed when the fuel tank 1 is fully charged.

The third vent pipe 6 has a rise portion 15 vertically extending to such a height that head pressure thereof is higher than the set pressure of the check valve 12.

Figure 2:
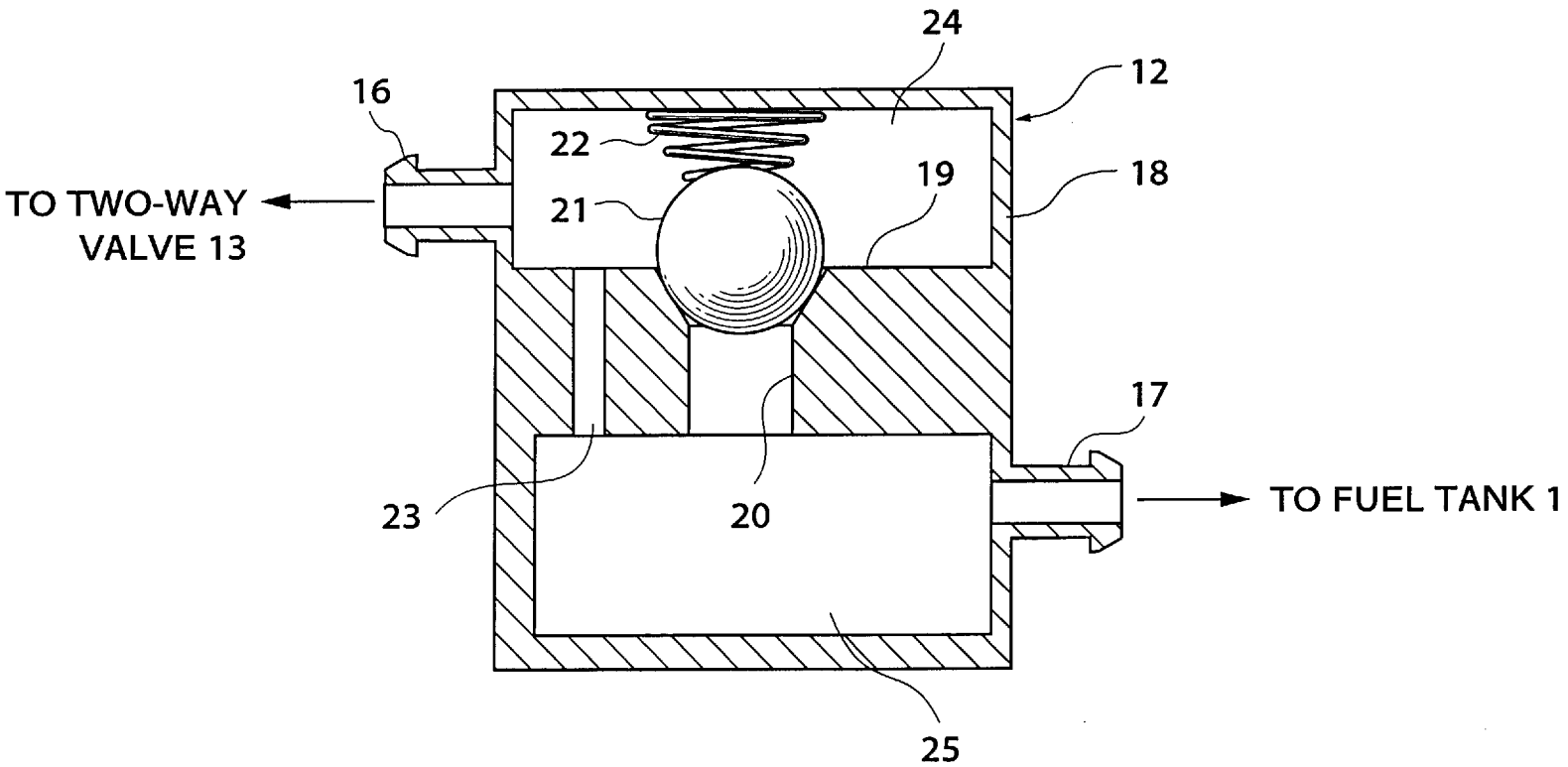
FIG. 2 is a longitudinal sectional view showing the construction of a first check valve appearing in FIG. 1 on an enlarged scale.

Further, as shown in FIG. 2, the check valve 12 has a casing 18 having an outlet port 16 formed in a front end wall thereof at a relatively higher location and an inlet port 17 formed in a rear end wall thereof at a relatively lower location. The casing 17 has two chambers 24 and 25 defined therein and partitioned from each other by a partition wall 19 disposed at a vertically central portion thereof. The chambers 24 and 25 communicate with the outlet port 16 and the inlet port 17, respectively. The partition wall 19 has a communication hole 20 formed therethrough and communicating between the two chambers 24 and 25. One end of the communication hole 20 (an upper open end in the figure) is opened and closed by a spherical valve element 21 which is urged by a coil spring 22 in a direction of closing the one end of the communication hole 20. Further, the partition wall 19 has a restriction 23 formed therethrough on one side of the communication hole 20 closer to the outlet port 16, which communicates between the two chambers 24 and 25. The restriction 23 has a predetermined bore size which causes a predetermined pressure loss.

Air can flow through the restriction 23 at a very small rate, and when the pressure within the tank exceeds a predetermined value, the valve element 21 is opened to allow air to flow through the communication hole 20.

The check valve 12 is normally in a closed state with the communication hole 20 being closed by the valve element 21, as shown in FIG. 2. When the pressure within the fuel tank 1 exceeds a predetermined value, the valve element 21 is urged upward by the pressure from the fuel tank 1 against the biasing force of the spring 22 to open the communication hole 20. Thus, the two chambers 24 and 25 communicate with each other through the communication hole 20, to thereby open the check valve 12.

Next, description will be made of the operation of the fuel tank venting system according to the present embodiment constructed as above.

FIG. 1 shows a state in which the fuel level within the fuel tank 1 is above the predetermined level (the fuel tank 1 is in the fully charged state) and at the same time the fuel tank 1 is in a horizontal position and hence the fuel liquid surface is horizontal. In this state, the anti-overcharging valve 9 is closed.

On the other hand, when the fuel level within the fuel tank 1 is below the predetermined level, the cut valves 7 and 8 and the anti-overcharging valve 9 are all in open states. In this state, when refueling is made through the filler pipe 2, air within the fuel tank 1 flows through the breather pipe 3 to be emitted from the other end of the filler pipe 2 into the atmosphere. Further, when the fuel level rises to such a level that the end of the breather pipe 3 is immersed in the fuel, emission of air within the fuel tank through the breather pipe 3 into the atmosphere ceases, whereby refueling of the fuel tank 1 is automatically stopped. This is because the end of a fuel injection gun for refueling the fuel tank 1 is then immersed into the fuel within the fuel tank 1.

Thereafter, air escapes from the fuel tank 1 through the anti-overcharging valve 9 so that the fuel liquid surface in the other end of the filler pipe 2 lowers. Therefore, when refueling of the fuel tank 1 is again carried out, the anti-overcharging valve 9 is closed due to a rise of the fuel liquid surface in the fuel tank 1, whereby air can escape from the fuel tank 1 only through the cut valves 7, 8. On this occasion, since the set pressure sum of the check valve 12 and the two-way valve 13 arranged across the confluent vent passage 30 downstream of the cut valves 7, 8 is higher than the head pressure A assumed when the fuel tank 1 is fully charged, no air within the fuel tank 1 is emitted into the atmosphere. As a result, refueling of the fuel tank 1 does not take place, leading to prevention of overcharging of the fuel tank 1.

Further, the third vent pipe 6 with the one end thereof connected to the anti-overcharging valve 9 has the other end thereof connected to the confluent vent passage 30 at a location intermediate between the valves 12 and 13, as mentioned above, and the pressure within the third vent pipe 6 cannot exceed the set pressure of the two-way valve 13. As a result, the maximum pressure within the fuel tank 1 is controlled to the set pressure of the two-way valve 13, which makes it possible to satisfy the puff-loss condition. If the predetermined pressure value below which the pressure within the fuel tank is to be controlled is further lowered due to a revision of the U.S. standards prescribing the puff-loss condition in future, this can be easily coped with by increasing the set pressure of the check valve 12 and lowering the set pressure of the two-way valve 13. On the other hand, if the pressure within the third vent pipe 6 can rise to a level as high as the set pressure sum of the valves 12 and 13, the pressure within the fuel tank 1 cannot be controlled to a value below the predetermined value in the designated test mode, which cannot satisfy the puff-loss condition.

Further, when the fuel tank 1 is tilted so that the fuel liquid surface within the fuel tank 1 is inclined relative to the fuel tank 1, as indicated by a line L1 or L2 in FIG. 1, fuel flows from the fuel tank 1 through the cut valve 7 or 8 into the first vent pipe 4 or the second vent pipe 5. That is, the cut valves 7 and 8 have such a construction that leakage of fuel from the fuel tank 1 cannot be completely prevented when the cut valve is immersed in the fuel. Therefore, when the vehicle is parked in a slanted state over a long time, fuel leaks at a small rate from the cut valve 7 or 8 which is then positioned at a lower level, into the first vent pipe 4 or the second vent pipe 5. For example, when the vehicle is parked in a forwardly inclined position over a long time, the fuel liquid surface within the fuel tank 1 is inclined relative to the fuel tank 1, as indicated by the line L1, with the cut valve 7 immersed in the fuel, whereby fuel leaks at a small rate from the fuel tank 1 into the first vent pipe 4 and is stored there at a region above the cut valve 7 and below the line L1. Thereafter, when the vehicle moves and assumes a rearwardly inclined position so that the fuel liquid surface is inclined relative to the fuel tank 1 as indicated by the line L2, the fuel stored in the above region of the first vent pipe 4 passes through the vent pipe 4 and is temporarily stored in the gas-liquid separator 10 which is located on a side opposite to the cut valve 7 with respect to the fuel tank 1, and does not flow toward the engine. Thus, good gas-liquid separation performance can be achieved. Thereafter, when the vehicle again moves so that the fuel liquid surface within the fuel tank 1 returns into a proper horizontal state relative to the fuel tank 1, the fuel temporarily stored in the gas-liquid separator 10 returns through the cut valve 7 into the fuel tank 1. Similar gas-liquid separatun performance is achieved on the gas-liquid separator 11 side.

When the fuel liquid surface within the fuel tank 1 is inclined relative to the fuel tank 1 as indicated by the line L2 in FIG. 1, the anti-overcharging prevention valve 9 is immersed into the fuel. Since the anti-overcharging valve 9 also has such a construction that leakage of fuel from the fuel tank 1 cannot be completely prevented when the valve 9 is immersed in the fuel, fuel leaks at a small rate from the fuel tank 1 through the anti-overcharging value 9 into the third vent pipe 6. On this occasion, while the maximum pressure within the fuel tank 1 is limited to the set pressure sum of the valves 12 and 13, the maximum pressure within the third vent pipe 6 is controlled only to the set pressure of the two-way valve 13, resulting in a rise of the fuel level within the rise portion 15 by an amount corresponding to the set pressure of the check valve 12. Thus, by virtue of this rise portion 15, the gas-liquid separation performance for preventing leakage of fuel toward the engine can be achieved, and further, by controlling the pressure within the fuel tank by the two-way valve 13 alone, the puff-loss condition can be satisfied. If the check valve 12 had a conventional structure with a high degree of sealing, when the vehicle is sharply tilted or the pressure within the fuel tank largely increases due to high temperature or other factors, or when the rise portion 15 cannot be designed to have a sufficient height due to the structure of the vehicle chassis, the fuel flowing into the third vent pipe 6 would pass the top of the rise portion 15 and flows toward the two-way valve 13. To eliminate this inconvenience, according to the present embodiment, the restriction 23 is provided in the check valve 12 as shown in FIG. 2, which serves to restrain the amount of rise of the fuel level within the rise portion 15, to thereby prevent the fuel from passing the top of the rise portion 15 of the third vent pipe 6 to flow toward the two-way valve 13. To this end, the bore of the restriction 23 is set to such a value as to produce a minimum required pressure loss which does not spoil the function of prevention of overcharging of the fuel tank 1.

Besides, since the anti-overcharging valve 9 is arranged in fuel tank 1 at an upper central location thereof, even when refueling is made at a gas station with a slanted floor, the refueling can be stopped at a uniform fully charged amount of fuel without error.

Although in the above described embodiment, three vent pipes are provided, the number of vent pipes is not limited to three but may be any number insofar as it is at least two, i.e., for example, the two cut valves 7, 8 may be connected to a single common gas-liquid separator through a single common vent pipe. Further, if the fuel tank has a thin and flat shape extending flat in longitudinal and transverse directions of the vehicle, five vent pipes may be employed together with four cut valves and one anti-overcharging valve such that four of the vent pipes are connected respectively to the cut valves arranged at four corners of the fuel tank, and the remaining vent pipe to the anti-overcharging valve arranged at an upper central location of the fuel tank. This arrangement can achieve better performance.

What is claimed is:

1. A fuel tank venting system for a vehicle having an internal combustion engine installed therein, comprising:

first and second vent passages connected to said fuel tank and each having one end thereof located in said fuel tank at opposite side and upper locations thereof, said first and second vent passages having other ends;

a third vent passage connected to said fuel tank and having one end thereof located in said fuel tank at an upper central location thereof;

an anti-overcharging valve arranged in said fuel tank and connected to the one end of said third vent passage;

a first valve connected to the other ends of said first and second vent passages;

a confluent vent passage extending from said first valve toward said engine; and a second valve arranged across said confluent vent passage on one side of said first valve closer to said engine;

said third vent passage having another end thereof connected to said confluent vent passage at a location intermediate between said first valve and said second valve;

a sum of set pressure of said first valve and set pressure of said second valve being set to a value higher than head pressure of said fuel tank when said fuel tank is fully charged.

2. A fuel tank venting system as claimed in claim 1, including a gas-liquid separator interposed between each of the one ends of said first and second vent passages and said first valve.

3. A fuel tank venting system as claimed in claim 1, including a cut valve arranged in said fuel tank and connected to each of said one ends of said first and second vent passages.

4. A fuel tank venting system as claimed in claim 1, wherein said third vent passage has a rise portion vertically extending to such a height that head pressure thereof is higher than said set pressure of said first valve.

5. A fuel tank venting system as claimed in claim 1, wherein said first valve is a check valve.

6. A fuel tank venting system as claimed in claim 1, wherein said second valve is a two-way valve.

7. A fuel tank venting system as claimed in claim 1, wherein said first valve has a restriction formed therein.

8. A fuel tank venting system as claimed in claim 2, wherein said gas-liquid separator is arranged at a side of said fuel tank opposite to a side of said fuel tank at which an associated one of said first valve and said second valve is arranged.

* * * * *